US007096830B2

(12) United States Patent
Hollis et al.

(10) Patent No.: US 7,096,830 B2
(45) Date of Patent: Aug. 29, 2006

(54) MOUNTING ARRANGEMENT FOR ELECTRIC WATER PUMP

(75) Inventors: Thomas J. Hollis, Medford, NJ (US); David Allen, Escanaba, MI (US); Mark Bader, Escanaba, MI (US)

(73) Assignee: Engineered Machined Products, Inc., Escanaba, MI (US)

( * ) Notice: Subject to any disclaimer, the term of this patent is extended or adjusted under 35 U.S.C. 154(b) by 0 days.

(21) Appl. No.: 10/924,327

(22) Filed: Aug. 23, 2004

(65) Prior Publication Data

US 2006/0037564 A1 Feb. 23, 2006

(51) Int. Cl.
*F01P 7/14* (2006.01)

(52) U.S. Cl. ..... 123/41.08; 123/41.44; 417/410.1; 417/423.15

(58) Field of Classification Search ..... 123/41.08, 123/41.1, 41.44; 417/321, 352, 360, 410.1, 417/423.15

See application file for complete search history.

(56) References Cited

U.S. PATENT DOCUMENTS

| | | | | |
|---|---|---|---|---|
| 5,458,096 | A | 10/1995 | Hollis | |
| 5,503,118 | A * | 4/1996 | Hollis | 123/41.44 |
| 5,551,384 | A | 9/1996 | Hollis | |
| 5,724,931 | A | 3/1998 | Hollis | |
| 6,056,518 | A | 5/2000 | Allen et al. | |
| 6,499,442 | B1 | 12/2002 | Hollis | |
| 6,702,555 | B1 | 3/2004 | Allen et al. | |
| 2004/0081566 | A1 | 4/2004 | Bader et al. | |

* cited by examiner

*Primary Examiner*—Tony M. Argenbright
*Assistant Examiner*—Katrina Harris
(74) *Attorney, Agent, or Firm*—Drinker Biddle & Reath LLP

(57) ABSTRACT

A water pump assembly for controlling the flow of temperature control fluid in an internal combustion engine. The water pump assembly includes a housing with an inlet, an outlet and an electric motor assembly for causing fluid to flow from the inlet to the outlet. A housing includes a mounting flange for mounting the water pump to an engine. The mounting of the water pump permitting direct flow into or out of the engine from the water pump.

10 Claims, 6 Drawing Sheets

MOUNTING ARRANGEMENT FOR ELECTRIC WATER PUMP

FIELD OF THE INVENTION

This invention relates to a mounting arrangement for an electric water pump for controlling the heating and cooling of an internal combustion gasoline or diesel engine.

BACKGROUND OF THE INVENTION

As discussed in U.S. Pat. No. 6,499,442, entitled "Integral Waterpump/Electronic Engine Temperature Control Valve" as fuel is burned in an internal combustion engine, about one-third of the heat energy in the fuel is converted to power. Another third goes out the exhaust pipe unused, and the remaining third must be handled by a cooling system.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons, and intake manifold). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such circumstances since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, conventional coolant systems employ a thermostat. The thermostat operates as a one-way valve, blocking or allowing flow to the radiator. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, and since these components are normally situated along the same flow circuit as the engine block, it is not practical to completely shut off the coolant flow through the engine block.

Numerous proposals have been set forth in the prior art to more carefully tailor the coolant system to the needs of the vehicle and to improve upon the relatively inflexible prior art thermostats. The inventor of the present invention has patented several such improvements. In particular, U.S. Pat. Nos. 5,503,118, 5,458,096, 5,724,931, and 6,499,442 disclose improvements to conventional cooling systems. These prior art patents are all incorporated herein in their entirety by reference.

A water pump is used in conventional engines to circulate coolant through the engine. Conventional water pumps function as the primary mechanism for forcing the fluid to flow through the cooling system. The most common form of water pump is a mechanical centrifugal pump which utilizes a circulating impeller to force water to flow into the engine. While mechanical impeller type water pumps provide a sufficient amount of pressure and are highly reliable, they cannot be actively controlled for maximizing the efficiency of the cooling system.

Recently, electric water pumps have been developed which provide for more efficient control of the flow of a fluid. Examples of some electric water pumps are described in U.S. Pat. Nos. 6,056,518 and 6,702,555, and U.S. Published Patent Application 2004/0081566, which are all assigned to Engineered Machine Products, Inc., one of the leaders in electric water pump design. These patents and patent applications are each incorporated herein by reference in their entirety.

As described above, conventional cooling systems utilize a valve for controlling circulation of coolant between the radiator and the engine. Typically, the water pump and the thermostat are mounted separate from one another. U.S. Pat. No. 6,499,442 describes a unique combination of an electric water pump and an electronic temperature control valve. In this system, the control valve is located within a housing that is directly connected to the water pump, thus permitting relatively direct fluid flow between the valve and the pump drive mechanism.

While U.S. Pat. No. 6,499,442 describes an improved combined water pump and valve arrangement, its mounting arrangement relative to the engine is not optimized. A need exists for a more efficient and optimized mounting arrangement for an electronic water pump.

SUMMARY OF THE INVENTION

The present invention is directed to an electric water pump for controlling the flow of temperature control fluid in an internal combustion engine that includes an engine block having a fluid inlet and a radiator. The water pump is designed to receive flow of temperature control fluid from the radiator. The water pump includes a housing with an inlet and outlet. The inlet is adapted to be connected to a radiator in a conventional manner. The outlet is designed to communicate with the inside of an engine block. An electric motor assembly is mounted within the housing and adapted, during operation, to cause fluid flow from the inlet to the outlet. The housing includes a mounting flange for mounting the housing to an engine block. The mounting flange is located on the housing so as to position the outlet of the housing directly at the fluid inlet of the engine block.

In one embodiment, the water pump further includes an electronic engine temperature control valve located within a housing mounted to the inlet of the water pump. The valve includes a valve member reciprocatable between first and second positions for controlling flow of temperature control fluid from the radiator to the inlet of the water pump. An electronic control system controls the actuation of the valve between the first and second positions.

In an alternate embodiment, the water pump is designed such that the inlet of the water pump is mounted to the engine head and controls flow of temperature control fluid out of the head and to the radiator.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with one or more preferred embodiments, it will be understood that it is not intended to limit the invention to any particular embodiment. On the contrary, it is intended to cover all alternatives, modifications, and equivalents as may be included within the spirit and scope of the invention as defined by the appended claims.

Certain terminology is used herein for convenience only and is not to be taken as a limitation on the invention. Particularly, words such as "upper," "lower," "left," "right," "horizontal," "vertical," "upward," and "downward" merely describe the configuration shown in the figures. The terms "inhibiting" and "restricting" are intended to cover both partial and full prevention of fluid flow.

For the sake of brevity, when discussing the flow of temperature control fluid in the engine, it should be understood that the fluid flows through water jackets formed within the engine. For example, when discussing the flow of temperature control fluid through an engine block, it should be understood that the fluid is flowing through a water jacket of the engine block.

Figure 1:
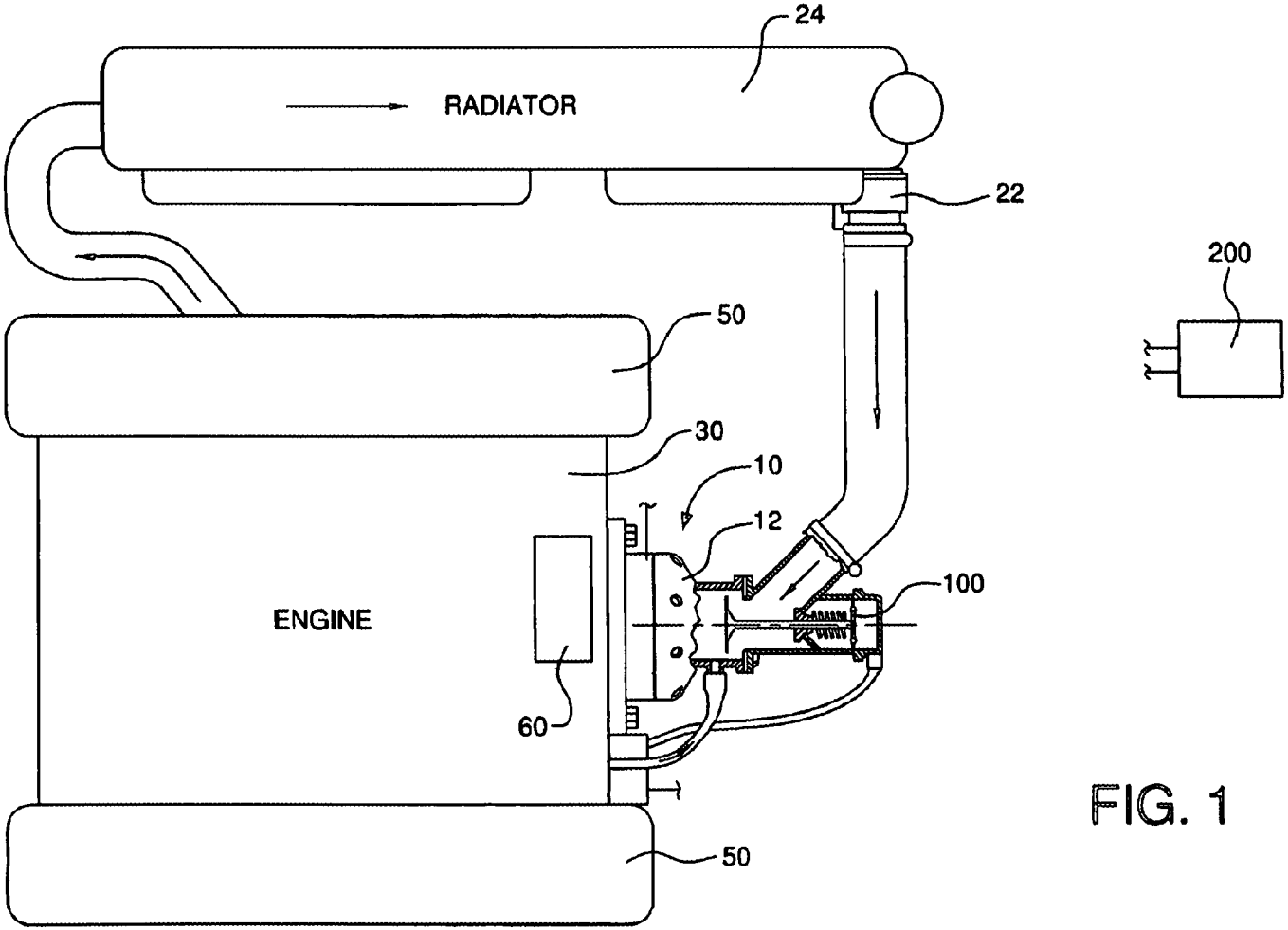
FIG. 1 is schematic top view of an internal combustion engine illustrating the location of an electronic water pump in accordance with one embodiment of the present invention.
Figure 2:
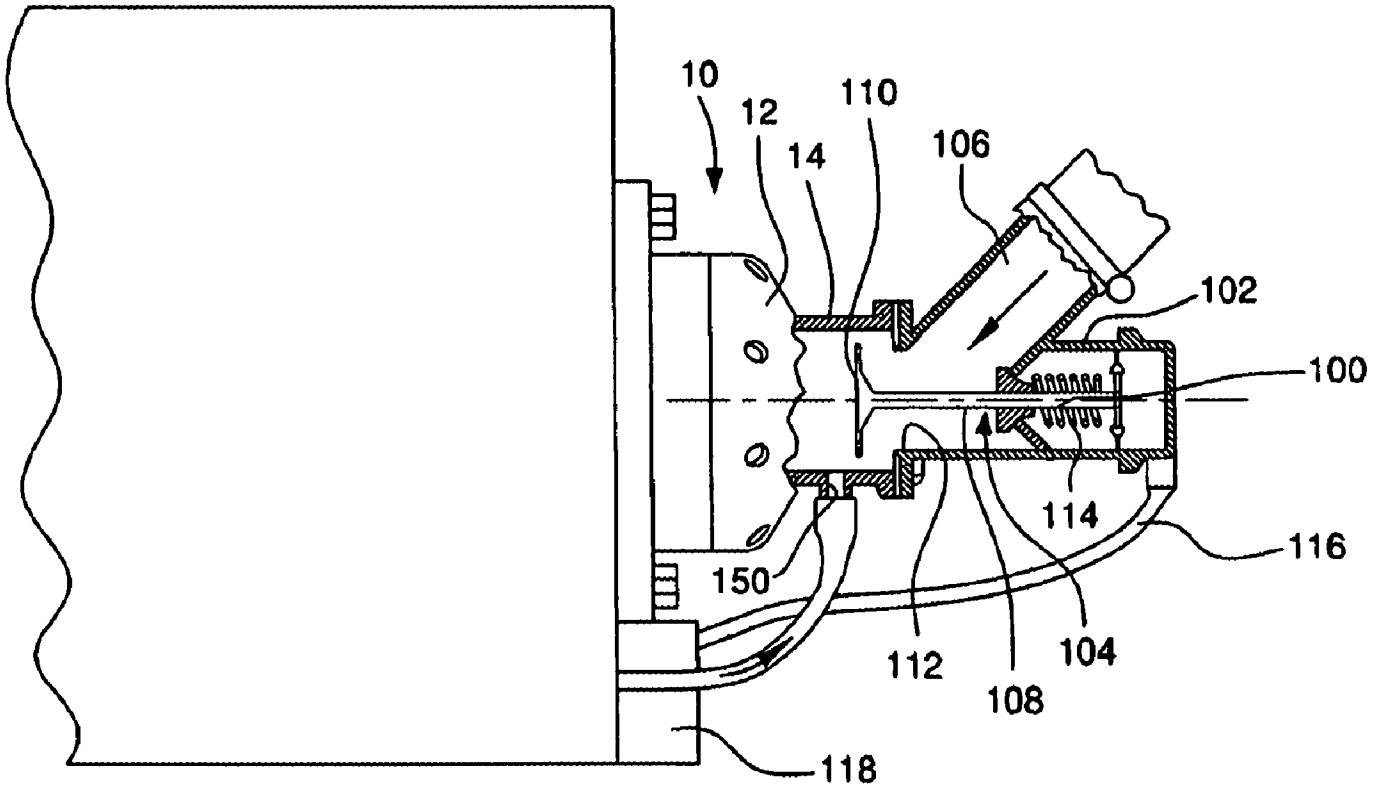
FIG. 2 is an enlarged view of a water pump and valve combination in accordance with one embodiment of the present invention.
Figure 3:
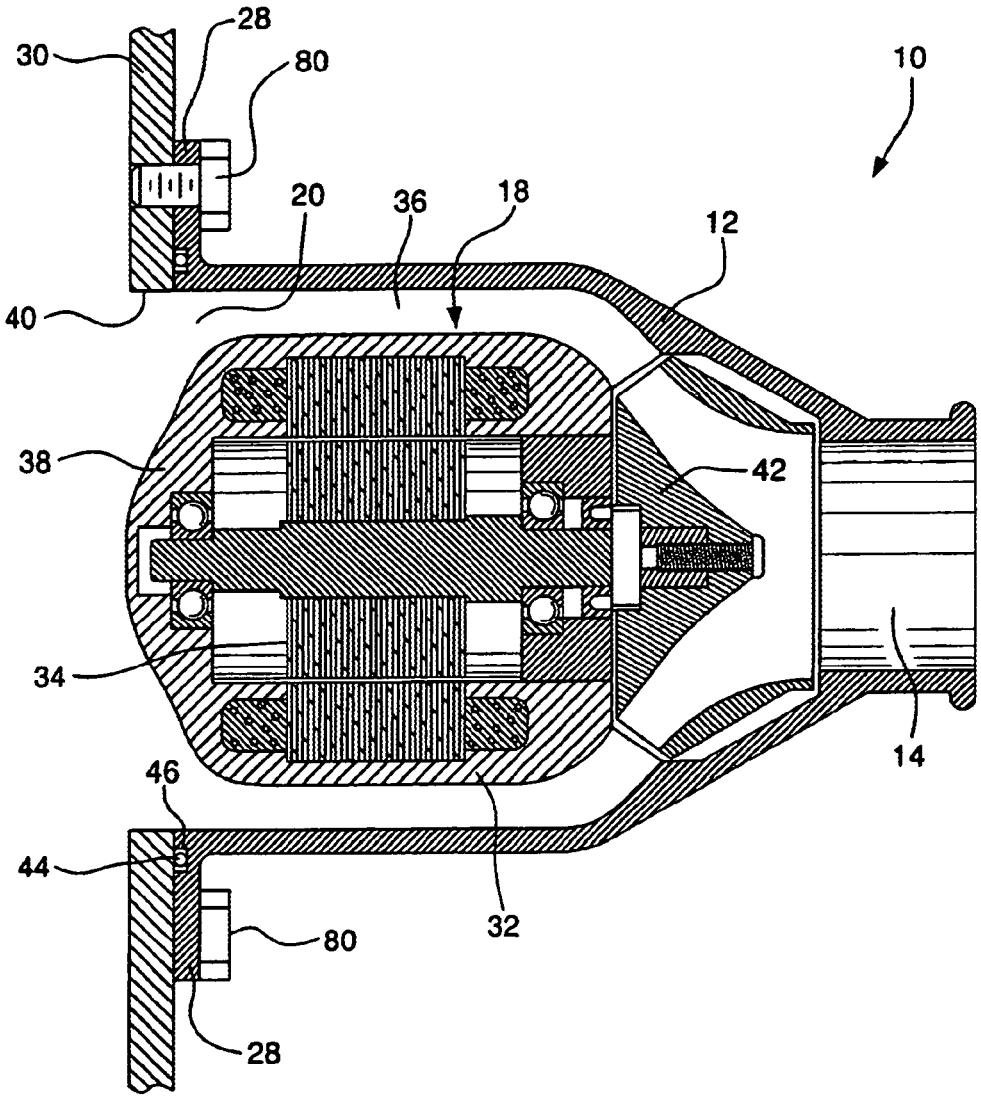
FIG. 3 is a cross-sectional view of one embodiment of a mounting arrangement for the electronic water pump for controlling flow into the engine block.

FIGS. 1–3 illustrate a water pump in accordance with one embodiment of the present invention and is generally designated with numeral 10. The water pump 10 is an electronic water pump which is powered by the vehicle's battery or other power source. The water pump includes a housing 12 with an inlet 14, an electric motor assembly 18, and an outlet 20.

In the illustrated embodiment, the inlet 14 is in fluid communication with an outlet 22 of a radiator 24 of the engine.

Referring now to FIG. 3, the housing 12 includes an engine mounting flange 28 for directly mounting the housing 12 to the engine block 30. While the flange 28 is shown as formed integral with the housing 12, it is also contemplated that the flange 28 could be a separate component that is attached to the housing 12. The flange 28 projects radially outward from the housing 12 so as to provide a structure for mounting the electronic water pump to the engine. In the illustrated embodiment, the flange 28 extends circumferentially about the housing adjacent to the outlet 20 of the housing 12. As will be discussed below, the location of the flange is configured to position the outlet 20 of the water pump 10 directly at the flow passage into the engine. Fasteners 80, such as bolts, extend through holes formed in the flange 28 for attaching the housing 12 to the engine block 30. The holes are preferably spaced equiangularly about the housing 12.

As shown in FIG. 3, the motor assembly 18 includes a stator assembly 32 which surrounds an internally mounted rotor assembly 34. The construction and operation of the electronic water pump 10 is described in detail in U.S. Pat. Nos. 6,056,518 and 6,702,555, and U.S. Published Patent Application 2004/0081566, and thus no further discussion is needed. The stator assembly 32 is spaced apart from the housing 12 so as to define a flow path 36 through the water pump 10. The rear of the stator assembly preferably includes a contoured tail portion 38 to assist in channeling the flow of coolant, thereby preventing pockets of flow stagnation.

The mounting flange 28 is located on the housing 12 so that when the housing 12 is mounted to the engine block 30, the outlet 20 of the water pump 10 is positioned directly at the opening 40 into the engine block 30. As shown in FIG. 3, the flow past the stator assembly 32 transitions directly into the engine block 30 in alignment with the longitudinal axis of the rotor assembly 34, with very minimal disruption in the direction of the fluid flow. The tail 38 is located at or even slightly in the opening 40 of the engine block 30.

The direct mounting of the housing 12 to the block 30 has several benefits. First, such a mounting arrangement locates the outlet 20 of the water pump 10 directly at or even within the engine block. Thus, flow out of the water pump 10 is not affected by external piping considerations. Prior art mounting arrangements for electric water pumps have included piping (flow tubes) between the outlet of the water pump and the inlet of the engine. In many cases the tubing inner diameter would affect the flow leaving the electric motor. The present invention addresses this issue by mounting the water pump directly to the engine, thus eliminating the need for piping, or minimizing the size of the piping, after (downstream from) the electric motor.

Also, the elimination of the flow tube between the outlet and the engine block in the water pump shown in U.S. Published Patent Application 2004/0081566 eliminates a potential leakage location and potential source of temperature loss that might occur from air flow across the tubing.

The elimination of the tubing also provides for a more compact water pump configuration, reducing the overall weight of the system. The engine compartment of a present day vehicle has limited space. As such, any reduction in component size is highly desirable.

Furthermore, the direct hard mounting of the water pump to the engine reduces vibrations which can cause deterioration of the hose structure (leading to leaks) and other engine components. By configuring the mounting flange such that it is located about the axis of rotation of the rotor, the loads on the housing 12 generated by the rotation of the impeller 42 will transfer as shear into the engine block which is more preferable than the loading imposed by other water pumps.

Thus, temperature control fluid passing from the inlet 14 of the water pump through the electric motor assembly 18 and out through the outlet 20 flows directly into the engine block for cooling the engine.

In order to minimize leakage between the housing 12 and the engine, an o-ring or similar seal 44 is preferably located on the flange. A recess 46 may be formed in the flange 28 to retain the seal 44.

Figure 4:
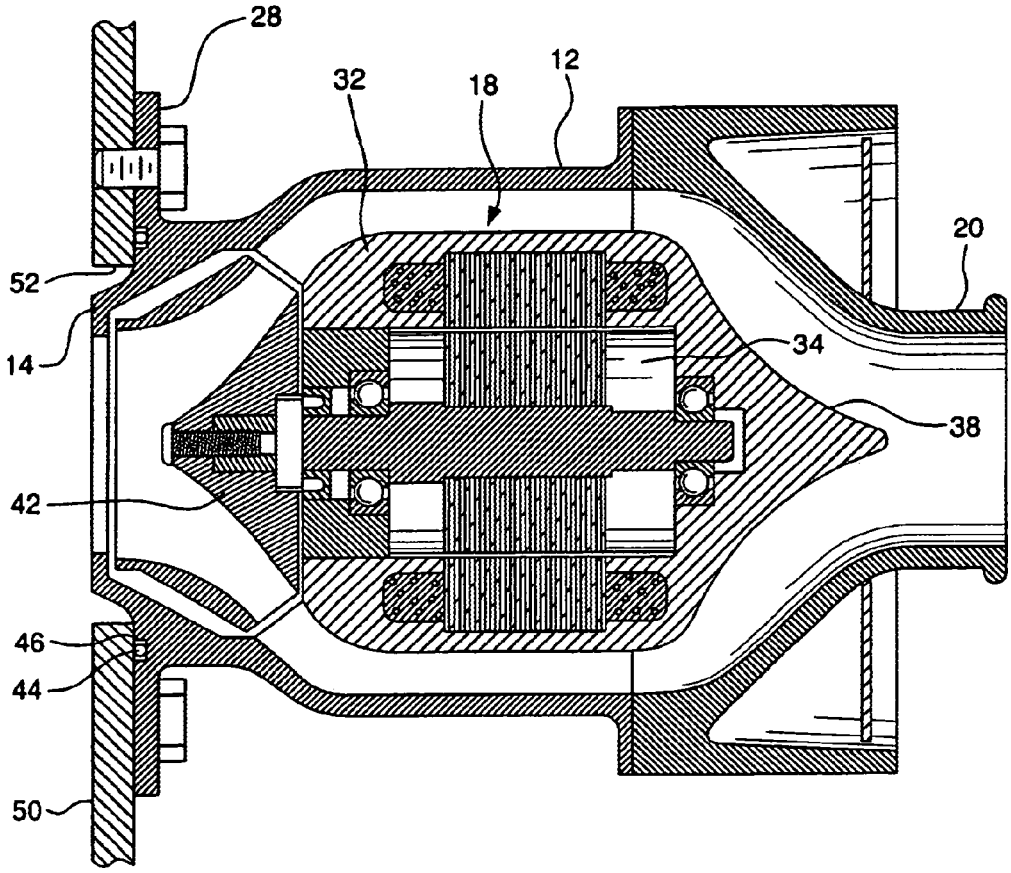
FIG. 4 is a cross-sectional view of another embodiment of a mounting arrangement for the electronic water pump for controlling flow out of the head of the engine.

While the present invention has been described as being mounted for channeling flow from the radiator into the engine through the block, it is also contemplated that the electric water pump 10 could be located at the outlet of the head 50 or the intake manifold 60 on the engine so as to draw coolant out of the engine. One configuration of the water pump according to this embodiment of the invention is shown in FIG. 4. In this embodiment, the impeller 42 is located between the stator assembly 32 and the head 50 of the engine. This permits the water pump 10 to draw the coolant out of the engine head 50. As with the prior embodiment, a mounting flange 28 is attached to the housing 12 for mounting the water pump 10 to the engine head 50. The flange 28 extends radially outward from the housing 12 in the proximity of or adjacent to the impeller 42. Thus, upon mounting to the engine head 50, the impeller is located adjacent to the opening 52 in the head 50. In order to control the flow entering the water pump, it may be desirable to include an inlet 14 for channeling coolant into the impeller 42.

As with the prior embodiment, the mounting of the water pump to the engine head is such that flow exits out of engine and directly into the water pump 10, without any change in direction. This provides increased efficiency with reduced stress the water pump. As more stringent exhaust emission and fuel economy standards are established, future installations may include the possibility of two or even three electric water pumps on the engine. Direct engine mounted E/EP's will afford numerous efficiency advantages including improved vibration, lower pressure drop and lighter weight.

As described in U.S. Pat. No. 6,499,442, it is sometimes beneficial to include a valve in combination with the electric water pump. Referring to FIGS. 1 and 2, an embodiment of the invention is shown with an electronic engine temperature control valve 100 located within a valve housing 102 that is mounted between the water pump inlet 14 and the outlet 22 of the radiator 24. It is also contemplated that the valve housing 102 and the water pump housing 12 may be formed as a single unit such that the valve 100 is located within the engine pump housing upstream from the electric motor assembly 18. As shown, for simplicity of construction, there are two separate housings. The two housings are attached using any suitable means, such as by bolting, clamping or welding. Preferably, the pump 10 and valve 100 are arranged so that the flow from the valve 100 to the electric motor assembly 18 is along a substantially straight path.

The electronic engine temperature control valve 100 may be any suitable valving system that can be controlled electronically, such as a stepper motor. In one embodiment, the valve 100 is an hydraulically controlled valve. A valve assembly 104 is mounted within the valve housing 102 and controls flow of temperature control fluid between the inlet 106 and the electric motor assembly 18. The valve assembly 106 preferably includes a reciprocatable valve member 108 with a valve head 110 mounted on a valve stem or shaft. The valve head 110 is preferably located within a valve passage 112 located within the housing 102. Reciprocation of the valve member 108 moves the valve head 110 toward and away from the valve passage 112. The valve member 108 is biased by a spring 114 into either an open or closed position, depending on the configuration of the system. A pressure source supplies a medium for displacing the valve member 108. The medium may be pressurized hydraulic fluid that is supplied from the oil pump or other pressure source. A fluid inlet tube 116 attaches to the housing 102 for supplying the pressurized fluid.

A detailed description of the electronic engine temperature control valve 100 is provided in U.S. Pat. No. 5,458,096, the specification of which is hereby incorporated by reference.

A flow valve solenoid 118 preferably controls flow of pressurized oil along the fluid inlet line 116. A suitable solenoid and hydraulic injection system is described in detail in U.S. Pat. No. 5,638,775 entitled "System for Actuating Flow Control Valves in a Temperature Control System," which is incorporated herein by reference in its entirety. The solenoid receives commands from an engine control unit, digital controller, signal processor or similar type of controller for providing control signals. For the sake of brevity, the controller will be referred to herein as the ECU 200.

The control valve 100 is actuatable between first and second positions. In FIG. 1, the control valve 100 is shown in its first position. When the control valve 100 is in its first position the water pump operates to circulate temperature control fluid from the radiator through the inlet 14 and into the engine block 30. When the control valve 100 is in its second position (not shown), the valve head 110 seats against the valve passage 112 and inhibits flow of temperature control fluid from the radiator into the water pump 10.

The housing 12 preferably includes a bypass inlet 150 which permits a flow of temperature control fluid into the electric motor assembly 18 from a location other than the inlet 12. The bypass inlet 150 may be attached through a flow tube directly to the cylinder head manifold (immediately prior to the attachment of the radiator inlet), or may be attached to a heat exchanger mounted in the oil pan for heating the oil. In the illustrated embodiment, the bypass inlet 150 attaches directly to the housing between the control valve 100 and the motor assembly 18.

As shown, the flow into the water pump through the bypass inlet 150 is not obstructed when the control valve 100 is in either of its first or second positions. The larger flow diameter of the valve inlet 106 relative to the bypass inlet 150 guarantees that the primary flow into the water pump 10 will be from the radiator when the control valve 100 is in its first position.

The water pump 10 has two modes of operation corresponding to the two positions of the control valve 100. In the first mode of operation, the water pump 10 channels temperature control fluid from the radiator to the engine to control the engine during normal or warm engine operation (i.e., after engine start-up.) In the second mode of operation, the engine is typically cold (i.e., during start-up.) As such, it is desirable in use the temperature control fluid to assist in heating the engine by heating the engine oil. In this mode, the heat from the hotter parts of the engine is transferred to the colder areas, such as the engine oil. In the second mode, the control valve 100 inhibits flow of from the radiator thereby causing the temperature control fluid to be continually recirculated through the engine block (via the bypass inlet 150) without being cooled by the radiator.

The ECU 200 preferably controls the actuation of the valve 100 based on predetermined values. Preferred methods of operation of the ECU 200 are described in detail in U.S. Pat. Nos. 5,669,335, 5,507,251 and 5,657,722, which are incorporated herein by reference in their entirety. The ECU 200 determines when and for how long the valve 100 should operate in a particular position.

The present invention provides a novel electric water pump mounting arrangement for controlling flow of temperature control fluid in an engine. The mounting arrangement permits direct flow into (or out of) the engine, thus minimizing unnecessary internal pressures, flow restrictions and the like. By minimizing these internal loads, the result is a more robust cooling system.

Also, while the present invention has described the water pump as including a control valve, it is contemplated that a valve may not be included. Furthermore, although an electronic control system has been described as controlling only the control valve, it is also contemplated that the ECU 200 could be used to control operation of the electric motor assembly 18 of the water pump instead of or in addition to the valve. As such, the circulation of the water pump can be controlled so as to control the flow of the temperature control fluid directly through the engine block.

Figure 5:
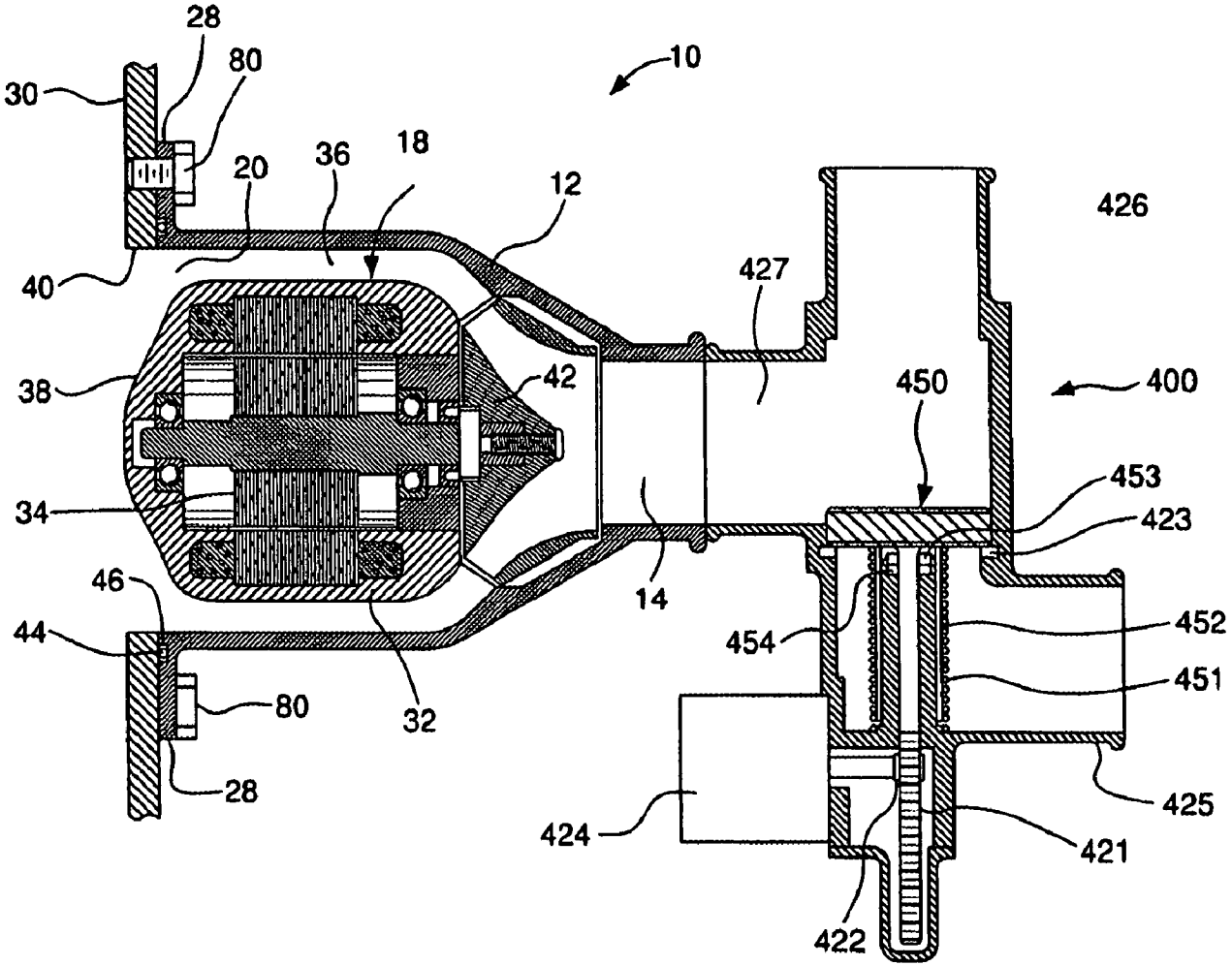
FIGS. 5 and 6 are cross-sectional views of an alternate embodiment of an electronic valve for use with the electronic water pump.

Referring now to FIG. 5, a variation on the embodiment of FIG. 3 is shown. In this embodiment a more preferred rack and pinion valve is used to control flow into the pump. More particularly, the valve 400 receives fluid from a radiator inlet 425 and a bypass inlet 426 and mixes/proportions the fluid and directs it to the pump through an outlet 427. A piston is used to prevent radiator flow during cold starts by resting against a seal 423. The piston is controlled by a rack and pinion system and includes a bellows/spring combination. The piston and shaft 421 are now one piece and the shaft includes teeth along a portion of it that are driven by a pinion gear 422 engaged with a motor 424. As the motor rotates, it drives the piston in a linear fashion to position it in the bore.

The piston shaft may be surrounded by an elastomer/spring combination called a bellows. The bellows has two functions, it seals the piston shaft and motor cavity from the operating fluid and it provides the spring source for the fail-safe mode. The bellows is comprised of two elements, the elastomer outer portion and the spring. The length of the bellows may be designed such that its natural resting state positions the piston midway within the mixing chamber. This way, any time power is lost or interrupted to the motor, the piston is automatically positioned such that it allows partial flow to the radiator thus providing a "fail-safe" mode. Another benefit of this specific length is by positioning the piston part way in the mixing chamber, it keeps the piston from resting, and possibly sticking against a seal or end housing during long periods of rest, for example if the vehicle is in storage. A third benefit of this specific length is the bellows is alternately stretched or compressed only half its full travel from this natural state as the piston moves its full travel. This lessens the stress on both the spring and elastomer and greatly increases the life of the bellows versus the normal method of installing the bellows in a preloaded state and only compressing it during operation.

Figure 6:
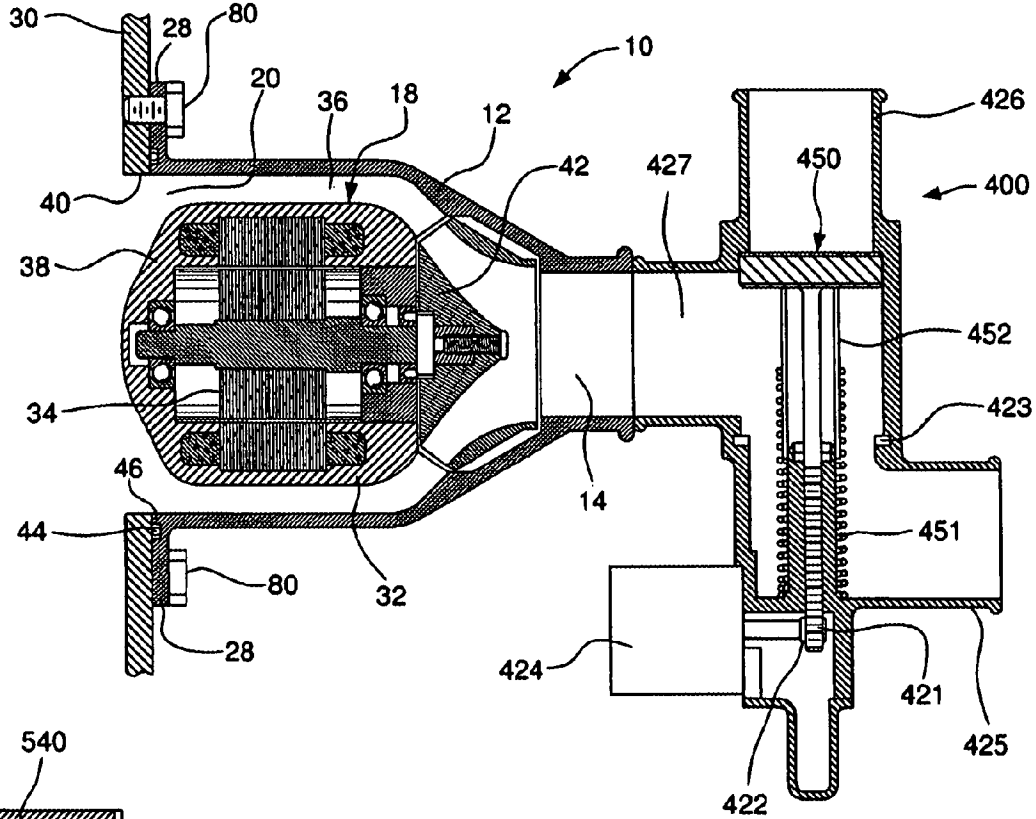

An alternative sealing mechanism is shown in FIGS. 5 and 6. In this embodiment, the piston assembly 450 includes a sleeve 452 that rides in close proximity to the housing of the valve and acts as a shield to prevent large debris from reaching an internally mounted scraper 453 and seal 454. The scraper and seal 453, 454 prevent fluid from reaching the motor cavity. In this embedment, the spring 451 provides a force to move the piston assembly anytime the motor loses power. The length of the spring is such that the natural resting state of the piston assembly is preferably at about the mid-point of its travel so as to provide the "fail-safe" mode discussed above. FIG. 5 shows the piston assembly positioned so as to allow full flow from the bypass loop and no flow from the radiator. FIG. 6 depicts the piston assembly positioned so as to allow full flow from the radiator.

Figure 7:
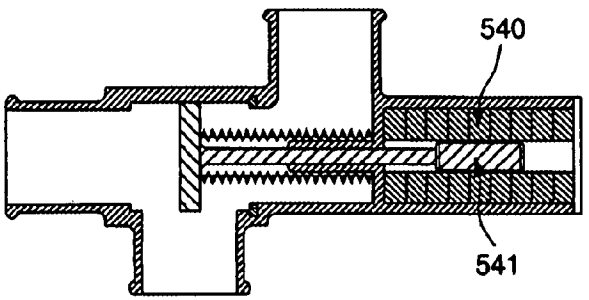
FIG. 7 is a further embodiment of an electronic valve for use in the present invention.

An alternative to the rack and pinion drive is to position the piston using an electric solenoid. This is generally depicted in FIG. 7. In this embodiment, the shaft is attached to the piston on one end and a solid metallic slug 541 is attached to the other end. Coils 540 are sequentially activated to position the slug 541 with respect to the coils 540. Again, a spring may be used to return the piston to its neutral position, preferably in the center of the mixing chamber, in the event of power loss.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. An electric water pump for controlling the flow of temperature control fluid in an internal combustion engine that includes an engine block having a fluid inlet opening, and a radiator, the water pump adapted to receive flow of temperature control fluid from the radiator, the water pump comprising:

a housing with an inlet and outlet, the inlet adapted to be connected to a radiator and the outlet adapted to communicate with the inside of an engine block; and an electric motor assembly mounted within the housing and adapted during operation to cause fluid flow from the inlet to the outlet of the housing;

the housing having a mounting flange for mounting the housing to the engine block, the mounting flange being located on the housing so as to position the outlet of the housing directly at the fluid inlet opening of the engine block, the electric motor assembly positioned within the housing such that a portion of the electric motor assembly is located within the fluid inlet opening of the engine block.

2. An electric water pump according to claim 1 further comprising an electronic engine temperature control valve including a housing mounted to the inlet of the water pump and connected to an outlet of the radiator, the valve having a valve member reciprocatable between first and second positions, the valve member adapted to permit flow of temperature control fluid from the radiator to the inlet of the water pump in the first position and inhibiting flow in the second position, the valve member positioned so as to control flow of temperature control fluid from the radiator to the inlet of the water pump;

a bypass inlet formed in the water pump housing and adapted to channel a flow of temperature control fluid into the water pump; and an electronic control system adapted to control the actuation of the valve between the first and second positions.

3. An electric water pump according to claim 1 further comprising an o-ring seal mounted on the flange on a side of the flange facing the housing outlet.

4. An electric water pump according to claim 3 wherein the flange includes a recessed cavity extending around the housing and wherein the o-ring seal is located within the cavity.

5. An electric water pump according to claim 1 wherein the housing has a longitudinal axis that extends substantially from the inlet to the outlet, and wherein the flange is positioned on the housing such that the housing is adapted to mount to the engine so as to position the longitudinal axis substantially perpendicular to the opening in the engine, thus permitting direct flow into the engine.

6. An electric water pump for controlling the flow of temperature control fluid in an internal combustion engine that includes an engine having an internal coolant water jacket with a flow opening in the engine to permit flow between the water jacket and the outside of the engine, and a radiator, the water pump adapted to control flow of temperature control fluid through the flow opening between the radiator and the water jacket of the engine, the water pump comprising:

a housing with an inlet and outlet, one of the inlet or the outlet adapted to be connected to a radiator and the other of the inlet or the outlet adapted to communicate with a coolant water jacket of an engine;

an electric motor assembly mounted within the housing and adapted during operation to cause fluid flow from the inlet to the outlet of the housing, the housing having a mounting flange for mounting the housing to the engine, the mounting flange being located on the housing so as to position the one of the inlet or the outlet that communicates with the coolant water jacket directly at the flow opening in the engine, the electric motor assembly positioned within the housing such that a portion of the electric motor assembly is located within the flow opening of the engine.

7. An electric water pump according to claim 6 further comprising an electronic engine temperature control valve including a housing mounted to the inlet of the water pump and connected to an outlet of the radiator, the valve having a valve member reciprocatable between first and second positions, the valve member adapted to permit flow of temperature control fluid from the radiator to the inlet of the water pump in the first position and inhibiting flow in the second position, the valve member being mounted so as to reciprocate toward and away from the electric motor assembly, the valve member being positioned so as to control flow of temperature control fluid from the radiator to the inlet of the water pump;

a bypass inlet formed in the water pump housing and adapted to channel a flow of temperature control fluid into the water pump; and an electronic control system adapted to control the actuation of the valve between the first and second positions.

8. An electric water pump according to claim 6 further comprising an o-ring seal mounted on the flange on a side of the flange facing the housing outlet.

9. An electric water pump according to claim 8 wherein the flange includes a recessed cavity extending around the housing and wherein the o-ring seal is located within the cavity.

10. An electric water pump according to claim 6 wherein the housing has a longitudinal axis that extends substantially form the inlet to the outlet, and wherein the flange is positioned on the housing such that the housing is adapted to mount to the engine so as to position the longitudinal axis substantially perpendicular to the opening in the engine, thus permitting direct flow into the engine.

* * * * *